US006402164B1

(12) United States Patent
Gonthier

(10) Patent No.: US 6,402,164 B1
(45) Date of Patent: Jun. 11, 2002

(54) DEVICE FOR RETAINING A BOOT ON A GLIDING BOARD

(75) Inventor: Jean-François Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/564,753

(22) Filed: May 4, 2000

(30) Foreign Application Priority Data

May 7, 1999 (FR) ..... 99 06049

(51) Int. Cl.[7] ..... B62B 9/04

(52) U.S. Cl. ..... 280/14.22; 280/618

(58) Field of Search ..... 280/613, 611, 280/616, 617, 618, 623, 624, 625, 626, 627, 628, 630, 631, 632, 633, 634, 14.21, 607, 14.22

(56) References Cited

U.S. PATENT DOCUMENTS 5,040,945 A * 8/1991 Levesque
5,727,797 A 3/1998 Bowles ..... 280/14.2
5,971,419 A * 10/1999 Knapschafer ..... 280/41.2 X
5,975,557 A * 11/1999 Snoke et al. ..... 280/624
6,070,484 A * 6/2000 Sakamaki
6,283,482 B1 * 9/2001 Coulter ..... 280/14.22

FOREIGN PATENT DOCUMENTS

| | | |
|---|---|---|
| DE | 29700738 | 7/1997 |
| EP | 0838248 | 4/1998 |
| FR | 2766336 | 1/1999 |

OTHER PUBLICATIONS

Plastics, DuBois and John, 5th Edition, pp. 229–234, dated Dec. 1974.*

* cited by examiner

*Primary Examiner*—Brian L. Johnson
*Assistant Examiner*—Bryan Fischmann
(74) *Attorney, Agent, or Firm*—Greenblum & Bernstein, P.L.C.

(57) ABSTRACT

A device for retaining a boot on a gliding board. The device includes a base, an arrangement for retaining the boot on the base, an arch affixed to the base, and a cuff journalled with respect to the base. An abutment is affixed to the cuff to limit a rotation of the cuff with respect to the base in a front-to-rear direction, the abutment having a toothing. A base is attached on the cuff, the base having a toothing that cooperates with the toothing of the abutment to wedge the abutment on the cuff.

26 Claims, 2 Drawing Sheets

Fig. 2
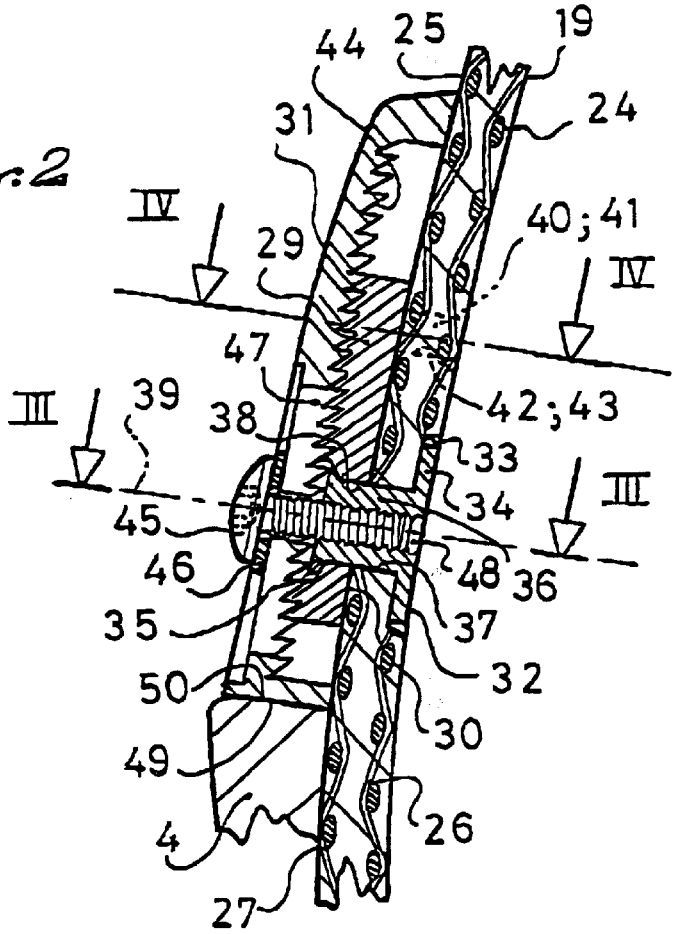
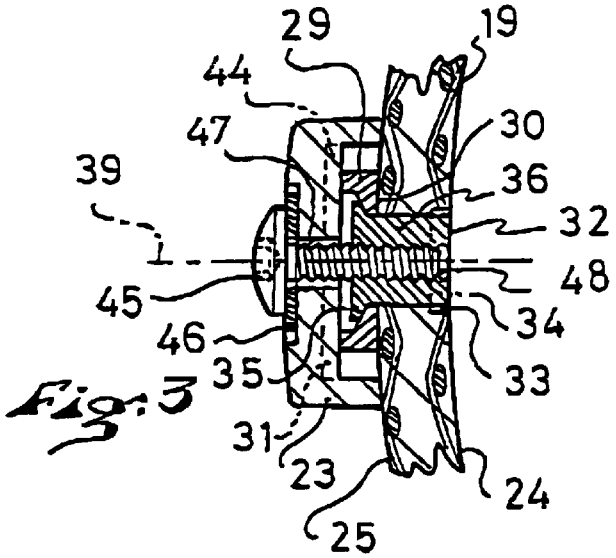
Fig. 3
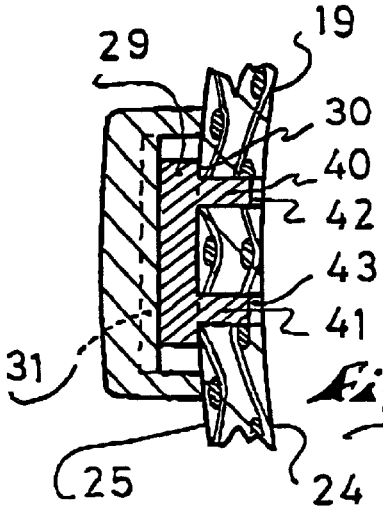
Fig. 4

DEVICE FOR RETAINING A BOOT ON A GLIDING BOARD

BACKGROUND OF THE INVENTION

1. Field of the Invention

The present invention relates to the field of devices for retaining a boot on a gliding board, and relates more particularly to a device provided to retain a flexible boot.

2. Description of Background and Relevant Information

Generally, a device of the aforementioned type is itself retained on the gliding board, and it includes means for removably retaining the boot.

In a known manner, these means can include a latching mechanism associated with a base of the device, and attachment means associated with the boot, the latching mechanism cooperating with the attachment means to retain the boot.

The retaining means can also have one or more removable linkages maintaining the boot on a boot-supporting base of the device, or directly on the board.

In any event, the flexibility of the boot, especially in the area of the upper, enables a user to bend or incline the legs when operating the board. However, it is often necessary that the user be able to take support with the rear of the lower leg. This is why the retaining device is generally provided with a cuff that opposes a reward inclination of the lower leg.

In the case of snowboarding, a support with the rear of the lower leg enables the user to undertake a turn in which his/her back is turned to the slope. Indeed, snowboarding involves both feet being oriented substantially in a transverse direction with respect to the board.

In the case of skiing, especially if the length of the ski is reduced with respect to the user's height, a support with the rear of the lower leg enables the user to manage his/her balance.

It has also been proposed to obtain a cuff that has a homogeneous structure composed of a plastic material. For example, the constituent material of the cuff can be selected because it has a good fatigue strength. Thus, it maintains its initial shape over time, in spite of the frequency and intensity of the forces exerted by the user.

In snowboarding, this phenomenon appears in rear turns having short radii of curvature, for which the board must be substantially inclined.

In skiing, the phenomenon appears especially during jump landing, where a rear support prevents a rearward fall.

Therefore, it has proven necessary to modify the structure of the cuffs so as to take into account the forces exerted thereon when a lower leg takes a rearward support.

To this end, it has been proposed, for example, to obtain a cuff that has a non-homogeneous structure composed of fibers contained in a synthetic material. This cuff has a very good resistance to bending, as well as a reduced mass. However, it appears, when operating the board, that the abutment does not remain in the desired position. When the user presses down toward the rear with the lower leg, the abutment is displaced with respect to the cuff, and the cuff pivots up to an end position that is different from the position selected by the adjustment of the abutment.

This phenomenon is due to a sliding of the toothing of the abutment relative to the toothing of the cuff. The sliding occurs because the fibers contained in the cuff prevent the obtaining of sharp edges in making the teeth of the toothing of the cuff.

It has also been proposed to obtain a cuff that has an homogeneous structure composed of a plastic material. For example, the constituent material of the cuff can be selected because it has a good fatigue strength. Thus, it maintains its initial shape over time, in spite of the frequency and intensity of the forces exerted by the user.

However, it also appears, when operating the board, that the abutment does not remain in the desired position.

This phenomenon is sometimes due to a deformation of the teeth of the toothing, or sometimes to a rupture of the teeth.

SUMMARY OF THE INVENTION

An object of the invention in particular is a retaining device that includes a cuff, as well as an adjustable abutment whose position with respect to the cuff is stable.

According to the invention, a device for retaining a boot on a gliding board includes a boot-supporting base, or baseplate, that has a front end and a rear end, and which is provided to receive the sole of the boot, the device extending along a longitudinal direction that passes by the front end and by the rear end of the base, the device further having an arrangement for retaining the boot on the base, such as straps extending over the boot, an arch affixed to the base so as to surround the heel of the boot, and a cuff journalled with respect to the base along a journal axis oriented in a substantially transverse direction of the device, the cuff being provided to receive a rear portion of the boot upper, an abutment being affixed to the cuff, by a reversible tightening mechanism, to limit rotation of the cuff with respect to the base in a front-to-rear direction along the journal axis, the abutment having a toothing. P A base is attached to the cuff, the base having a toothing that cooperates with the toothing of the abutment to wedge the abutment on the cuff.

The material used to make the base allows obtaining a toothing that offers a sufficient mechanical strength, and whose teeth have sharp edges. Since the edges of the toothing of the abutment are also sharp, the base and the abutment maintain a fixed position with respect to one another when the tightening mechanism acts. As a result, the abutment remains in its adjustment position relative to the cuff. The advantage is that the cuff remains in the selected position when the user presses rearwardly with the lower leg.

BRIEF DESCRIPTION OF DRAWINGS

Other characteristics and advantages will be better understood from the description that follows, with reference to the annexed drawings illustrating, by way of non-limiting example, how the invention can be embodied, and in which:

FIG. 2 is a partial cross-section of the device along the line II—II of FIG. 1;

FIG. 3 is a partial cross-section along the line III—III of FIG. 2;

FIG. 4 is a partial cross-section along the line IV—IV of FIG. 2.

DETAILED DESCRIPTION OF THE INVENTION

Figure 1:
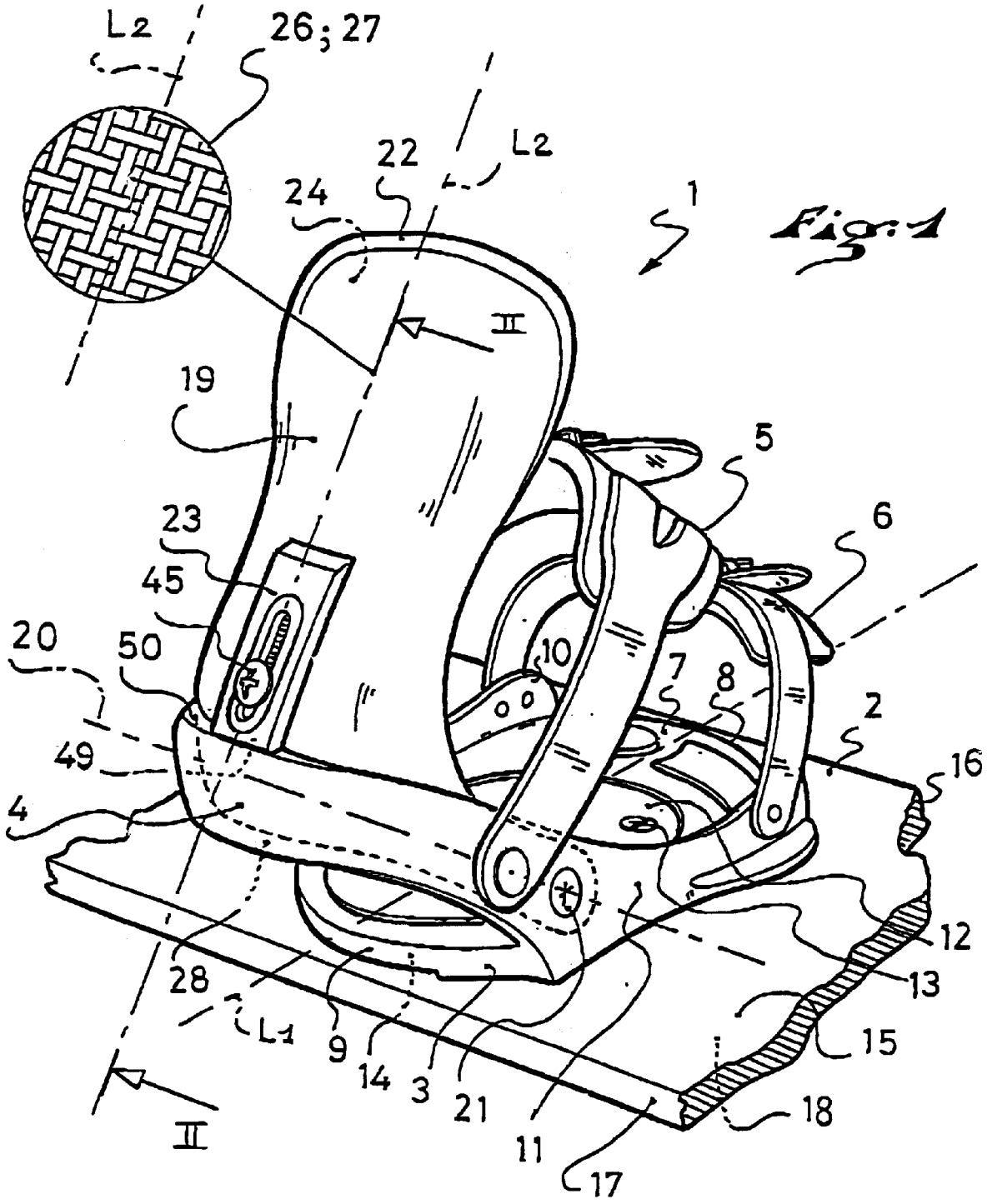
FIG. 1 is a rear perspective view of a retaining device according to the invention.

One embodiment of the invention is described hereinafter by means of FIGS. 1–4, for an application in the field of snowboarding.

In a known manner, as shown in FIG. 1, a retaining device 1 is affixed to a board 2 for retaining a boot, not shown, on the board 2. The device 1 is shown in a form that associates a boot-supporting base 3, or baseplate, with an arch 4 and linkages 5, 6, such as straps. The base 3 has an upper surface 7 provided to receive the sole of the boot, and extends along a longitudinal direction L1 between a front end 8 and a rear end 9.

The arch 4 connects lateral edges 10, 11 of the device 1 that are projecting with respect to the upper surface 7. The arch 4 goes around the heel of the boot when the latter is retained on the device 1. The linkages 5, 6 serve to removably maintain the boot on the device 1.

The structure and functioning of the linkages are well known to one with ordinary skill in the art. The device 1 is retained on the board 2 by a means shown in the form of a disk 12, which is itself retained on the board 2 by screws, such as the screw 13, for example.

The disk 12 makes it possible to flatten a lower surface 14 of the base 3 on an upper surface 15 to the board 2.

The device 1 is oriented substantially along a transverse direction of the board 2. This means that the front end 8 of the base 3 is located substantially in the area of a lateral edge 16 of the board 2, and that the rear end 9 of the base 3 is located substantially in the area of a lateral edge 17 of the board 2. The transverse direction of the board 2 extends from the edge 16 to the edge 17.

The board 2 also has a lower surface, or gliding surface 18, opposite the upper surface 15 with respect to the thickness of the board 2.

The device 1 further has a cuff 19 journalled with respect to the base 3 along a journal axis 20 oriented in a substantially transverse direction of the device 1. The journal of the cuff 19 is obtained, for example, with two rivets. One rivet 21 is located in the area of the lateral edge 11, and one rivet, not visible in FIG. 1, is located in the area of the lateral edge 10.

The cuff 19 can pivot with respect to the base 3, either in a rear-to-front direction, or in a front-to-rear direction.

The rear-to-front direction is a direction for bringing an upper end 22 of the cuff 19 closer to the front end 8 of the base 3. When the ends 22 of the cuff 19 and 8 of the base 3 are close to one another, the device 1 is in a folded position that reduces the space required. This facilitates transportation and storage.

Conversely, the front-to-rear direction is a relative spacing of the end 22 of the cuff 19 from the front end 8 of the base 3. When the user causes the cuff 19 to pivot in the front-to-rear direction, he encounters a limit defined by the position of an abutment 23 on the cuff 19. This is the configuration that is shown in FIG. 1. This is a position of use of the device 1. In this case, when the boot is retained on the device 1, the boot upper is in support on a front surface 24 of the cuff 19 in the area of the rear of the user's lower leg.

The attachment of the abutment 23 on the cuff 19 is explained hereinafter.

As is better understood by means of FIG. 2, the cuff 19 has a non-homogeneous structure.

This structure is obtained in the form of a sheet of composite material having fibers that are confined in a synthetic material such as a plastic material. The sheet has a surface that is the front surface 24, as well as a rear surface 25 opposite the front surface 24 with respect to the thickness of the sheet.

The synthetic material, which demarcates the thickness of the sheet, and therefore the thickness of the cuff 19, is preferably a hot-melt material. For example, it can be polypropylene, polycarbonate, polyethylene, polyurethane, or the like. The fibers can made of glass, carbon, polyamide, metal, metal alloy, a combination of these materials, or the like. The fibers are confined in the synthetic material, in the vicinity of the front 24 and rear 25 surfaces. A layer 26 of a fiber fabric is located in the vicinity of the front surface 24, and another layer 27 of a fiber fabric is located in the vicinity of the rear surface 25.

Each of the layers 26, 27 assumes the shape of the surface in the vicinity of which it is located.

As is better understood by means of the enlargement of FIG. 1, each layer 26, 27 has fibers that are oriented in a longitudinal direction L2 of the cuff 19 which passes by the upper end 22 and a lower end 28 of the cuff 19. Each layer 26, 27 also has fibers oriented in a direction that is substantially perpendicular to the longitudinal direction L2. This arrangement of the fibers imparts a good bending strength to the cuff 19 during a front-to-rear bias.

The cuff 19 can be made in the following manner. Initially, a thickness of synthetic material is made, for example, by calendering. The layers of fibers are then arranged on each side of the thickness, in contact with the material. The stack of fibers and material is then subject to a temperature and pressure increase in a mold or by calendering. The softening of the material enables a penetration of the fibers which remain in the material after cooling.

The cuff 19 could be made with another non-homogeneous structure. There are numerous other methods for implementing fibers affixed by resin, these methods being known to one with ordinary skill in the art.

According to the invention, as is understood by means of FIGS. 2–4, a base 29 is attached to the cuff 19, on the side of the rear surface 25. The base 29 has a support surface 30 provided to remain in contact with the rear surface 25 of the cuff 19, as well as a toothing 31 opposite the surface 30 with respect to the thickness of the base 29. As is understood by means of FIGS. 2 and 3, maintaining the base 29 on the cuff 19 is done by means of a rivet 32. A cutout 33 of the cuff 19 allows receiving a shoulder 34 of the rivet 32 on the side of the front surface 24. A flange 35 of the rivet 32, obtained by deformation after the positioning of the base 29 and of the rivet 32, retains the base 29 on the cuff 19. A body 36 of the rivet 32, located between the shoulder 34 and the flange 35, extends through openings 37 of the cuff 19 and 38 of the base 29. The body 36 and openings 37, 38 respectively have a circular shape, and have a common axis 39.

An element other than rivet can be used to retain the base 29 on the cuff 19. For example, one can use screws, adhesive, or call for a nesting or ratchet device, or the like.

As is understood by means of FIGS. 2 and 4, the base 29 has protuberances 40, 41 housed in cavities 42, 43 of the cuff 19. The protuberances 40, 41 serve to define the orientation of the base 29 with respect to the cuff 19. They serve as a foolproof guide during the mounting of the base 29 on the cuff 19.

As is understood by means of FIGS. 1, 2, and 3, the abutment 23 has a toothing 41 provided to nest into the toothing 31 of the base 29. Preferably, each of the toothings 44, 31 has a series of triangular-shaped teeth. Each tooth projects relative either to a surface of the abutment, or to a surface of the base. The projecting portion of a tooth is a dihedron whose first half-plane is substantially perpendicular to the surface it originates from, and whose second half-plane forms, together with the first, a sharp angle whose value can be comprised, for example, between 25 and 65 degrees. Each of the toothings 44, 31 could have teeth of square or trapezoidal cross-section, or the like. A reversible tightening mechanism, shown in the form of a screw 45 associated with a washer 46, makes it possible to tighten the abutment 23 on the base 29, such that their respective toothings are in mesh. The screw 45 extends through a slit 47 of the abutment 23 and cooperates with a threaded opening 48 obtained along the axis 39 in the body of the rivet 36.

When the screw 45 is tightened, the abutment 23 is in a fixed position with respect to the cuff 19. When the screw 45 is loosened, the position of the abutment 23 can be changed by modifying the relative position of the toothings 31, 44.

When operating the board 2, a rear support taken by the user brings a support surface 49 of the abutment 23 into contact with a stop surface 50 of the arch 4, because the cuff 19 is biased in the front-to-rear direction.

Regardless of the intensity of the force applied by the user, the teeth of the toothings 31 and 34 of the base 29 and of the abutment 23 remain in mesh. This is due to the fact that their geometry is precise, because the material which constitutes them has a homogeneous structure. For example, the abutment 23 and the base 29 can each be made of a synthetic material such as a polyethylene-, polycarbonate-, polypropylene-base plastic material, or the like. The abutment 23 and the base 29 could also be made of metal or metal alloy.

The advantage is that the cuff 19 remains in the position selected by the user during operation.

The invention is no longer limited to the embodiment thus described, and includes all of the technical equivalents that fall within the scope of the claims that follow.

In particular, other means for affixing the base 29 to the cuff 19 could be provided. For example, an adhesive, or even heat welding in the case where the synthetic material of the cuff is the same as that of the base, could be used.

Furthermore, it would be possible, for example, to make a cuff whose structure is homogeneous, the material constituting it being a plastic material. This material can have a certain flexibility to dampen the user's forces. Conversely, the base has a sufficient stiffness such that the toothings of the base and of the abutment remain nested when operating the board.

What is claimed is:

1. A device for retaining a boot on a gliding board, the device comprising a boot-supporting base that has a front end and a rear end, and which is provided to receive the sole of the boot, the device extending along a longitudinal direction that passes by the front end and by the rear end of the boot-supporting base, the device further comprising linkages to maintain the boot on the boot-supporting base, an arch affixed to the boot-supporting base so as to surround the heel of the boot, and a cuff journalled with respect to the boot-supporting base along a journal axis oriented in a substantially transverse direction of the device, the cuff provided to receive a rear portion of the boot upper, an abutment being affixed to the cuff, by a reversible tightening mechanism, to limit rotation of the cuff with respect to the boot-supporting base in a front-to-rear direction along the journal axis, the abutment having a toothing, wherein a base is affixed to the cuff, the base having a toothing that cooperates with the toothing of the abutment to wedge the abutment on the cuff, the base being made of a different material than the constituent material of the cuff.

2. A device according to claim 1, wherein the base and the toothing form an integral piece made out of a material that has a homogeneous structure.

3. A device according to claim 1, wherein the base and toothing are made out of a plastic material.

4. A device according to claim 1, wherein the base is maintained on the cuff by means of a rivet.

5. A device according to claim 1, wherein the base has a foolproof guide to define the orientation of the base with respect to the cuff during the mounting thereof on the cuff.

6. A device according to claim 1, wherein the cuff has a non-homogeneous structure composed of fibers that are confined in a plastic material.

7. A device according to claim 1, wherein the cuff has a thickness of plastic material demarcated by two surfaces, a layer of a fiber fabric being located in the vicinity of a surface, another layer of a fiber fabric being located in the vicinity of the other surface.

8. A device for retaining a boot on a gliding board, the device comprising:

a baseplate adapted to be secured to an upper surface of the gliding board and to support a sole of the boot, said baseplate having a front end and a rear end and extending longitudinally between said front end and said rear end;

an arch connected to and extending upwardly with respect to said baseplate, said arch positioned to extend around a heel of the boot;

a cuff journalled with respect to the baseplate along a transverse axis for rotation of said cuff about said transverse axis, said cuff having a forward facing surface positioned to engage a rear portion of an upper of the boot, with the sole of the boot supported by said baseplate, said cuff being made of a constituent material;

a base fixed to said cuff, said base having a plurality of teeth;

an abutment fixed to the cuff, in any of a plurality of positions, by a reversible tightening mechanism, said abutment having a plurality of teeth meshing with said plurality of teeth of said base to limit said rotation of the cuff about said transverse axis;

said base being made of a material different from said constituent material of said cuff.

9. A device according to claim 8, wherein:

said base and said plurality of teeth of said base form a unitary piece made from a material having a homogeneous structure.

10. A device according to claim 8, wherein:

said base and said plurality of teeth of said base are made from a plastic material.

11. A device according to claim 9, wherein:

said base and said plurality of teeth of said base are made from a plastic material.

12. A retaining device according to claim 8, wherein:

said base is fixed to said cuff by means of a rivet.

13. A retaining device according to claim 8, wherein:

said reversible tightening mechanism comprises a screw extending through said abutment.

14. A retaining device according to claim 8, wherein:

said base is fixed to said cuff by means of a rivet;

said reversible tightening mechanism comprises a screw extending through said abutment and threaded into said rivet.

15. A retaining device according to claim 8, wherein:

said base comprises a plurality of protuberances extending into cavities of said cuff for positioning said base in a determined orientation with respect to said cuff during fixing of said base on said cuff.

16. A retaining device according to claim 8, wherein:

said cuff has a non-homogeneous structure composed of fibers that are confined in a plastic material.

17. A retaining device according to claim 8, wherein:

said cuff is made of a plastic material having a thickness demarcated by two surfaces, a first layer of a fiber fabric located in the vicinity of one of said two surfaces, a second layer of a fiber fabric located in the vicinity of a second of said two surfaces.

18. A retaining device according to claim 8, wherein:

said abutment comprises a downwardly facing surface for engagement with a surface facing upwardly with respect to said arch.

19. A retaining device according to claim 8, wherein:

said plurality of teeth of said abutment and said plurality of teeth of said base are made from the same material.

20. A retaining device according to claim 19, wherein:

said material is a plastic.

21. A retaining device according to claim 19, wherein:

said material is a metal or a metal alloy.

22. A snowboard binding for retaining a boot on a snowboard, said snowboard binding comprising:

a baseplate adapted to be secured to an upper surface of the snowboard and to support a sole of the boot, said baseplate having a front end and a rear end and extending longitudinally between said front end and said rear end;

a pair of flanges extending upwardly from said baseplate and laterally spaced apart;

an arch extending upwardly from said flanges, said arch positioned to extend around a heel of the boot;

a strap, extending from one of said pair of flanges to another of said pair of flanges, to tighten the boot onto said baseplate;

a cuff journalled with respect to the baseplate along a transverse axis for rotation of said cuff about said transverse axis, said cuff having a forward facing surface positioned to engage a rear portion of an upper of the boot, with the sole of the boot supported by said baseplate, said cuff being made of a constituent material;

a base fixed to said cuff, said base having a plurality of teeth;

an abutment fixed to the cuff, in any of a plurality of positions, by a reversible tightening mechanism, said abutment having a plurality of teeth meshing with said plurality of teeth of said base to limit said rotation of the cuff about said transverse axis;

said base being made of a material different from said constituent material of said cuff.

23. A device for retaining a boot on a gliding board, the device comprising:

a baseplate adapted to be secured to an upper surface of the gliding board and to support a sole of the boot, said baseplate having a front end and a rear end and extending longitudinally between said front end and said rear end;

an arch connected to and extending upwardly with respect to said baseplate, said arch positioned to extend around a heel of the boot;

a cuff journalled with respect to the baseplate along a transverse axis for rotation of said cuff about said transverse axis, said cuff having a forward facing surface positioned to engage a rear portion of an upper of the boot, with the sole of the boot supported by said baseplate, said cuff being made of a constituent material;

a base fixed to said cuff, said base having a plurality of teeth;

an abutment fixed to the cuff, in any of a plurality of positions, by a reversible tightening mechanism, said abutment having a plurality of teeth meshing with said plurality of teeth of said base to limit said rotation of the cuff about said transverse axis;

said base and said cuff consisting of respective materials different with respect to each other.

24. A retaining device according to claim 23, wherein:

said base comprises a predeterminate material, and said cuff comprises said predeterminate material impregnated with fibers.

25. A retaining device according to claim 24, wherein:

said predeterminate material is a plastic.

26. A retaining device according to claim 23, wherein:

said base and said plurality of teeth of said abutment are made of an identical predeterminate material.

* * * * *